US005344042A

United States Patent [19]

Crosby et al.

[11] Patent Number: 5,344,042

[45] Date of Patent: Sep. 6, 1994

[54] OBJECT DISPENSER APPARATUS AND METHOD

[75] Inventors: Kennith D. Crosby; William J. Tuten, both of Scottsdale; Walter Luckeneder, Mesa, all of Ariz.

[73] Assignee: Creative Technology, Inc., Scottsdale, Ariz.

[21] Appl. No.: 85,074

[22] Filed: Jul. 2, 1993

Related U.S. Application Data

[62] Division of Ser. No. 746,491, Aug. 16, 1991, Pat. No. 5,251,782.

[51] Int. Cl.[5] ..... G07F 11/00

[52] U.S. Cl. ..... 221/2; 221/82; 221/121

[58] Field of Search ..... 221/2, 4, 5, 7, 8, 13, 221/76, 82, 83, 121, 122; 194/906

[56] References Cited

U.S. PATENT DOCUMENTS

| | | | |
|---|---|---|---|
| 4,354,613 | 10/1982 | Desai et al. | 221/4 |
| 4,519,522 | 5/1985 | McElwee | 221/13 |
| 4,598,810 | 7/1986 | Shore et al. | 221/5 |
| 4,635,053 | 1/1987 | Banks et al. | 221/2 |
| 4,695,954 | 9/1987 | Rose et al. | 221/2 |
| 4,793,761 | 12/1988 | Stern | 221/82 |
| 5,212,649 | 5/1993 | Pelletier | 221/122 |
| 5,251,782 | 10/1993 | Crosby et al. | 221/2 |

FOREIGN PATENT DOCUMENTS

| | | | |
|---|---|---|---|
| WO/8901675 | 2/1989 | European Pat. Off. | 194/906 |
| 2620842 | 3/1989 | France | 194/906 |

*Primary Examiner*—H. Grant Skaggs
*Attorney, Agent, or Firm*—Harry M. Weiss

[57] ABSTRACT

This disclosure specifically discloses a key (or other type of door opening object) dispensing apparatus and method that could be used for hotels, motels, rental car companies, and the like to dispense keys (or other door opening objects) to customers automatically, without a human attendant being present to effect the transaction. One embodiment of the present invention discloses a round carousel with hooks upon which metal keys are placed. The carousel is rotated to a position where the desired or selected key is in position to be dispensed from the apparatus and dispensing means then pushes the key off its hook allowing it to fall into a tray below. A second embodiment discloses the use of a standard 35 millimeter type slide carousel to hold plastic key cards commonly known as VING cards. The carousel is rotated to a position where the desired or selected card is in position to be dispensed from the apparatus and dispensing means then pivots a card gate away from the dispensing slot of the carousel, allowing the selected (key) card to fall into a tray below.

29 Claims, 4 Drawing Sheets

OBJECT DISPENSER APPARATUS AND METHOD

RELATED PATENT APPLICATION

The subject patent application is a Division of U.S. patent application Ser. No. 07/746,491 entitled "Object Dispenser Apparatus And Method" filed on Aug. 16, 1991 in the names of the same inventors as the subject patent application and now U.S. Pat. No. 5,251,782.

FIELD OF THE INVENTION

This invention relates generally to dispensing apparatus and methods, and more specifically to an apparatus and method for dispensing keys or other objects for opening door locks whereby an authorized person desiring access to a locked area can obtain a key or other door opening object to obtain access to the locked area without tile need of tile presence of a person to dispense the key or other door opening object. This type of key or other door opening object dispenser could be used for access into rooms in hotels or motels, into locked rental cars, private clubs, and other applications or situations where a business or other type of establishment could benefit from the labor savings or added convenience of automatically dispensing keys or other door opening objects to authorized persons.

DESCRIPTION OF THE PRIOR ART

Many businesses, such as hotels, motels, and rental car companies are required to be open 24 hours a day to service customers who need these services available to them at all hours because of the travel schedules of those customers and travel delays, etc. At times, the cost for these extended operating hours exceeds the additional revenue generated, since an employee must be available during all (24) hours to serve the potential customers. Many hotel and motel operators must choose between an uninterrupted night's sleep where they close down their guest registration office for a period of time, and the chance of receiving additional revenue by staying open late. Many business operators whose businesses are reasonably successful decide to forego the potential additional revenue, deeming the effort of being available at all hours to not be worth the additional revenue that would be generated. In addition, if an employee is managing a hotel or motel, they may choose to shunt down the guest registration office early or turn on the NO VACANCY sign even when rooms are still available to assure they are not disturbed after their selected business hours. Therefore, there existed a need to provide an apparatus and method whereby people desiring the services of hotels, motels rental cars, and other facilities that require access to locked areas to be able to obtain keys or other door opening objects, and, therefore, obtain access to these services or facilities automatically, without a human attendant being present to effect the transaction or to dispense the keys or other door opening objects.

In the past, several key dispenser systems have been used with limited success. The most popular, at the present time, is a system that uses two solenoids per key in an X-Y array. Such a system has proven to be unreliable due to noise generated by solenoid activation which often causes more than one key to be dispensed. Another system dispenses keys packaged in boxes or other forms of containers which are dispensed sequentially or in series. This system has the disadvantage that keys cannot be selected randomly thereby preventing a person from receiving a particular desired choice of room, car, etc. Therefore, there existed a need to provide an automatic key or other door opening object dispenser that can easily be operated by the customer which will reliably dispense only one key or door opening object which can be selected at random.

SUMMARY OF THE INVENTION

It is an object of this invention to provide an improved apparatus and method for dispensing items such as keys or other door opening objects.

It is a further object of this invention to provide an improved apparatus and method for dispensing items that can be placed on or in a carousel.

It is a still further object of this invention to provide an apparatus and method for dispensing keys or other door opening objects that can be placed on or in a carousel.

It is another object of this invention to provide an apparatus and method for dispensing keys or other door opening objects to persons desiring use of hotels, motels, rental cars, and other facilities restricted to those who have access to a key or other door opening object.

It is still another object of this invention to provide an apparatus and method for dispensing metal keys to authorized persons.

It is a still further object of this invention to provide an apparatus and method for dispensing plastic key cards commonly known as VING cards used in locks that have electronic means for performing the unlocking function.

According to the present invention, a key dispenser is provided. This apparatus comprises, in combination, means for verifying the person's authorization to receive a key, a carousel which holds a plurality of keys, means for rotating the carousel to select the appropriate key, and means for moving the appropriate key from the carousel to a tray where the person desiring the key can remove the key from the apparatus. In a typical application, the apparatus will preferably include a keypad, display, receipt printer, paper currency reader, and card reader mechanism for credit cards. The person desiring a key will choose the service desired using the keypad from a menu on the display which will determine which key is appropriate. The apparatus will request payment from the person, whereupon the person either inserts cash into the paper currency reader or a credit card into the card reader mechanism in the apparatus. Upon verification of payment, a receipt will be printed, and the receipt and appropriate key will be dispensed. In one embodiment of the present invention the key dispenser is sued to dispense metal keys. In another embodiment the key dispenser is used to dispense plastic key cards commonly known as VING cards.

The foregoing and other objects, features and advantages will be apparent from the following description of the preferred embodiments of the invention as illustrated in the accompanying drawings.

DESCRIPTION

Figure 1A:
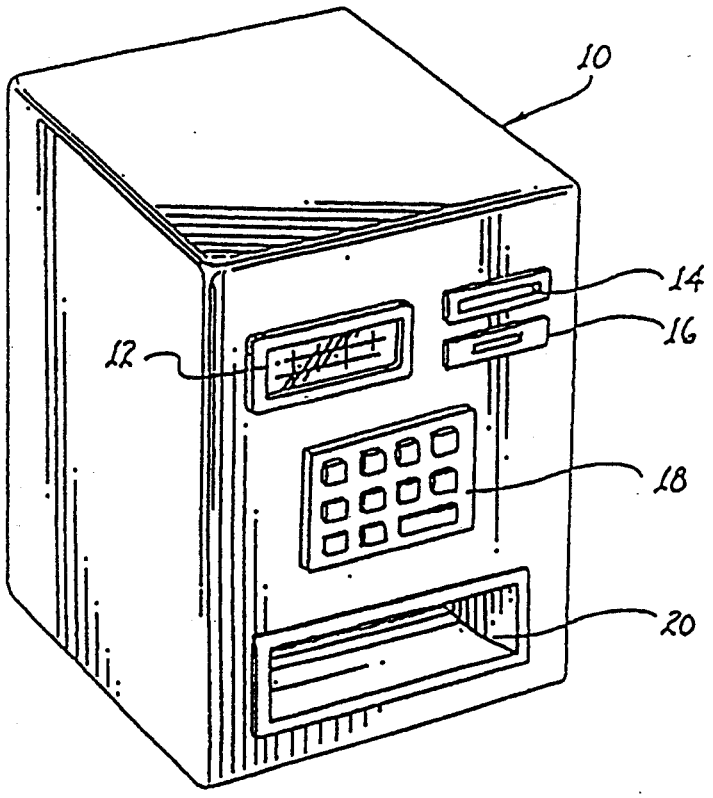
FIG. 1A is a perspective view of the front of the key dispenser of the present invention.

Referring to the figures, FIG. 1A shows the front of the key dispenser 10, which typically includes a display 12, a paper currency reader 14, a credit card reader 16, a keypad 18, and a tray 20 for removing the dispensed key and a receipt. The receipt printer and control electronics are not shown, and are internal to the key dispenser 10. The control electronics typically comprise a microprocessor with associated software and interface circuits.

The key dispenser 10 is typically mounted in a wall of a building such that customers can access the front side (FIG. 1A) while access to the back side (FIG. 1B) is restricted to employees. Key dispenser 10 is programmed and keys are loaded into the dispenser from the back of the unit, shown in FIG. 1B. The back of the unit includes a cover 22 for accessing the key carousel, a display 24, and a keypad 26. The manager, proprietor, or employee using the key dispenser 10 programs the needed information into the key dispenser 10 using the display 24 and keypad 26. At the same time keys can be placed in the key dispenser 10 in the appropriate places by removing cover 22.

Some of the features described above for the key dispenser 10 could be deleted depending on the particular application without departing from the scope of the present invention. For example, if credit card is the only acceptable form of payment, the paper currency reader could be deleted. If the key dispenser is to dispense keys without requiring payment, the credit card reader could be replaced by a card reader which would simply verify authorization. Likewise, the card reader could be deleted entirely and the person requesting access could simply enter in a password or code from the keypad to gain authorization to receive a key.

Other features could be added to the key dispenser 10 without departing from the scope of the present invention. For example, if change need be given, a paper currency dispenser and coin dispenser could be added. A telephone modem may be included to allow authorization of credit cards, or for loading programming information from an external computer. A connector 27 (FIG. 1B) could be added which would allow an external computer to program the key dispenser and to monitor the activity and status of the key dispenser. This remote programming feature would make the display 24 and keypad 26 of FIG. 1B unnecessary. The card reader could accept debit cards as payment as readily as credit cards.

In one embodiment of the present invention, key dispenser 10 dispenses metal keys. In another embodiment of the present invention, key dispenser 10 dispenses plastic key cards commonly known as VING cards. The primary difference between these two embodiments is the key dispenser assembly.

Figure 2:
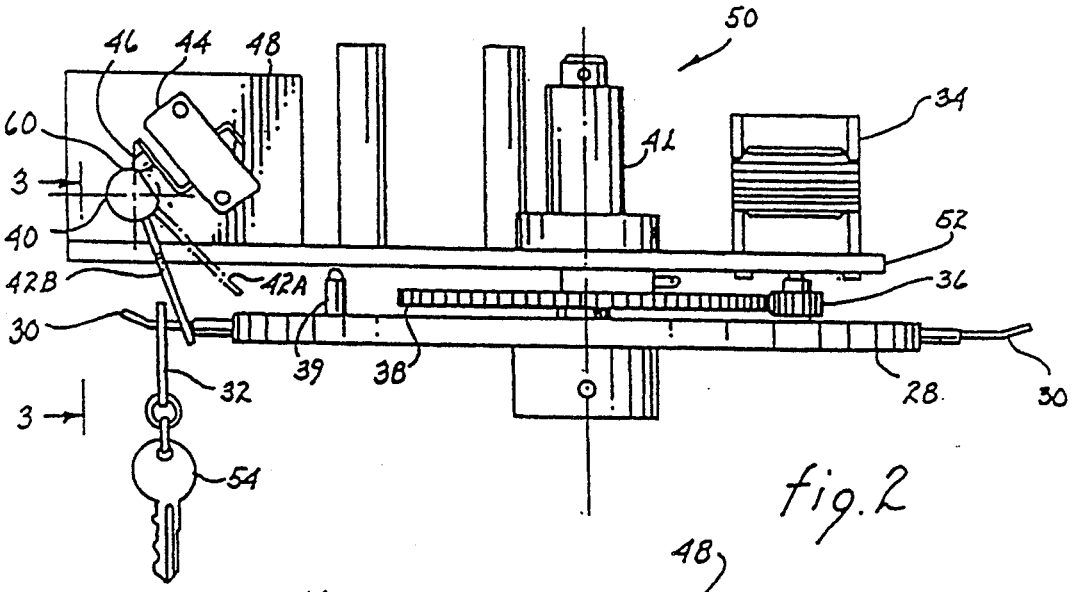
FIG. 2 is a side elevational view of the key carousel assembly of the first embodiment of the present invention which dispenses metal keys.

FIG. 2 shows a view of the key dispenser assembly 50 according to the first embodiment of the present invention, which is used to dispense metal keys. While many different objects could be dispensed in this manner, the following discussion addresses the dispensing of metal keys as one specific example, without limiting the scope of the present invention to metal keys alone.

Key dispenser assembly 50 includes a top plate 52, whereon is mounted a positioning motor 34 and a dispensing motor bracket 48. The shaft of positioning motor 34 has a gear 36 fixedly attached, which meshes with and drives a second gear 38. The positioning motor 34 is preferably a stepper motor. The number of steps of the positioning motor 34 and the number and pitch of the gear teeth on gears 34 and 36 determine the positioning resolution of the system, and allow accurately positioning the carousel such that the desired key will be properly dispensed. Gear 38 is fixedly mounted to carousel plate 28, causing carousel plate 28 to turn as the positioning motor 34 turns. Carousel plate 28 with associated gear 38 are movably mounted to top plate 52 using bearings and a hub 41 to allow rotation of carousel plate 28 in a plane parallel to the top plate 52.

Figure 7:
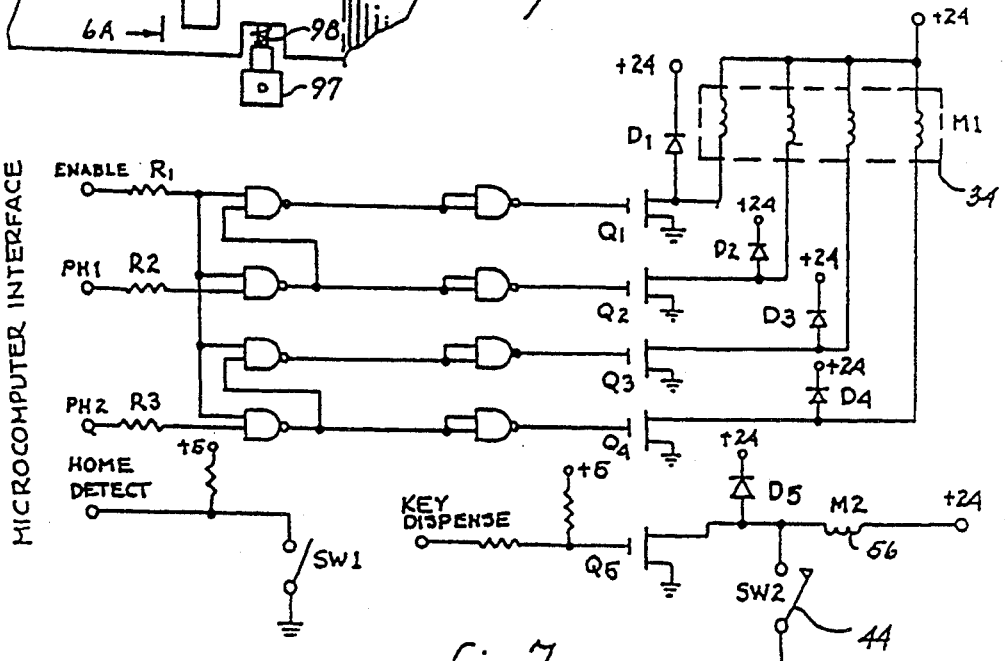
FIG. 7 is a schematic diagram showing the electrical connections and method for rotating the key carousel and dispensing a key.

Positioning motor 34 is typically driven by a drive circuit represented in FIG. 7. Inputs ENABLE, PH1, and PH2 are digital logic inputs, and are typically driven under software control to provide the desired stepping sequence, to effect rotation of positioning motor 34 in the appropriate direction for the appropriate number of steps required to align the desired key directly under the dispenser mechanism 49.

Referring again to FIG. 2, carousel plate 28 has mounted thereon a plurality of key hooks 30 whereupon are placed one item per hook. The key hooks 30 are bent upwardly as shown to assure that gravity keeps the items from slipping off the key hooks 30 as the carousel plate 28 is rotated by the positioning motor 34. Note that the metal key 54 or some keyring device 32 holding the key 54 can be placed on the key hook 30. As an example, FIG. 2 shows the key 54 hanging on a keyring device 32 for illustrative purposes.

A switch actuator 39 is also mounted to the carousel plate 28. This actuator 39 closes the contacts of a switch used to allow the control software to detect a reference position known as home position of the carousel plate 28. The circuitry for the HOME DETECT input is shown in FIG. 7. When the carousel is in home position, switch actuator 39 cause the contacts of SW1 to close, thereby generating a logical low input to the control circuitry. This switch to detect home position of the carousel may be either mechanical or optical. In the case of an optical switch, actuator 39 is replaced by a hole in gear 38 through which light passes from transmitter to receiver on the optical switch when the carousel is in home position. When the light passes from the transmitter of the optical switch through the hole in gear 38 to the receiver of the optical switch, the HOME DETECT signal is generated to the control circuitry, and thereby to the control software. In this manner the optical switch detects home position of the carousel plate 28.

Dispenser mechanism 49 includes dispensing motor bracket 48 fixedly connected to the top plate 52. Dispensing motor 56 (see FIG. 3) is mounted to dispensing motor bracket 48, and has a shaft 58 therethrough. The shaft 58 of the dispensing motor 56 is fixedly coupled to a fork hub 40. Attached to the fork hub 40 is the fork 42 which is used to push the selected key off the key hook 30. Fork hub 40 has a flat side 60 as shown to allow limit switch 44 to turn off the dispensing motor 56 after one complete revolution of the fork 42.

Figure 1B:
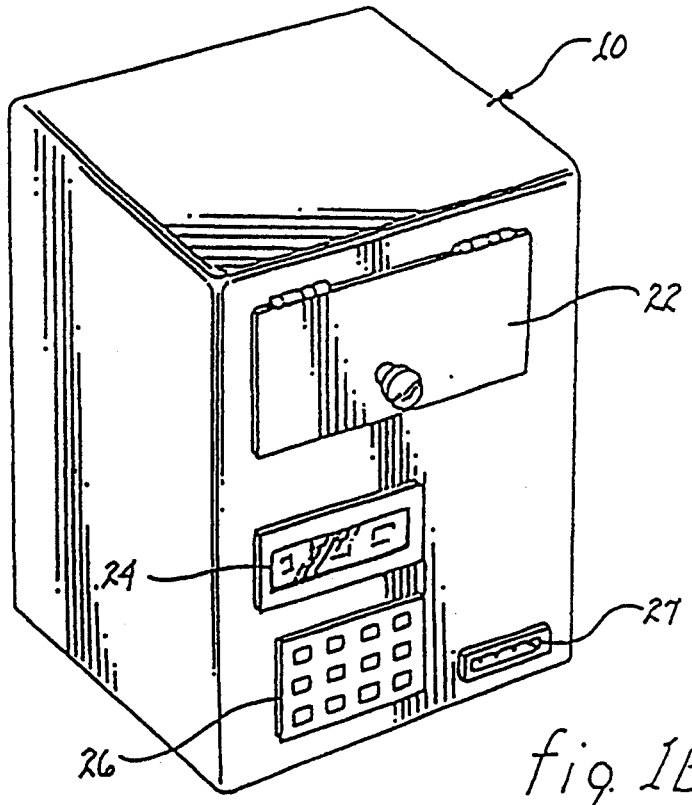
FIG. 1B is a perspective view of the back of the key dispenser of the present invention.
Figure 2A:
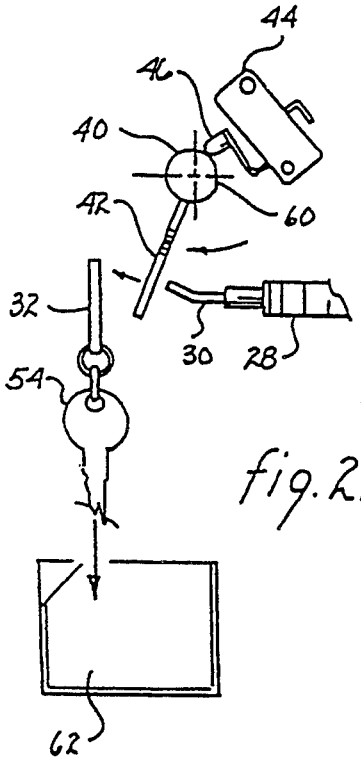
FIG. 2A is a partial side elevational view shown in FIG. 2 that shows the action of dispensing the key by pushing the key off the carousel.

FIG. 2A shows how the fork 42 pushes the keyring device 32 off the key hook 30. Fork 42 is normally in position 42A of FIG. 2 to allow unencumbered rotation (positioning) of the carousel plate 28. Once the appropriate key has been positioned directly under the key dispense mechanism 49, the dispensing motor 56 is activated under software control until switch actuator 46 is on the round part of fork hub 40 (position 42B in FIG. 2), which causes the contacts of limit switch 44 to close, thereby powering the dispensing motor 56. As the dispensing motor rotates the fork hub 40, fork 42 presses against the keyring device 32 and pushes it off the end of the key hook 30 as shown in FIG. 2A. The keyring device 32 and associated key 54 then fall by the force of gravity into a chute 62 below, which leads to the tray 20 in FIG. 1. After the keyring device 32 has been pushed off the key hook 30, the dispensing motor 56 continues rotating the fork hub 40 until the switch actuator 46 again encounters the flat portion 60 of fork hub 40, which causes the contacts of limit switch 44 to open, thereby stopping rotation of the dispensing motor 56 at position 42A shown in FIG. 2.

The activation of the dispensing motor 56 can best be understood by referring to FIG. 7. In the circuit with the KEY DISPENSE input, this input is driven to a logic low when the dispensing motor 56 is not activated. In this condition transistor Q5 is off and limit switch 44 is open, providing no ground path for the current to drive dispensing motor 56. When a key is to be dispensed, the software drives the KEY DISPENSE input to this circuit to a logical high state. In this condition Q5 is biased on, and thereby provides a ground path to power dispensing motor 56. The software continues to drive the KEY DISPENSE high for a predetermined period of time, then drives the KEY DISPENSE input to a logical low state. When the KEY DISPENSE input first goes high, the dispensing motor 56 begins to turn. This causes fork cam 40 to rotate such that the actuator 46 of limit switch 44 encounters the round portion of fork hub 40, causing the limit switch 44 to close. In this manner, the limit switch 44 continues to power the dispensing motor 56 even after the software has driven the KEY DISPENSE input low. Once the actuator 46 of limit switch 44 encounters the flat portion 60 of fork hub 40, the contacts of limit switch 44 open, interrupting the current flow to the dispensing motor 56 thereby stopping its rotation. In this manner the dispensing motor 56 is activated for only one revolution each time a key is dispensed.

Figure 3:
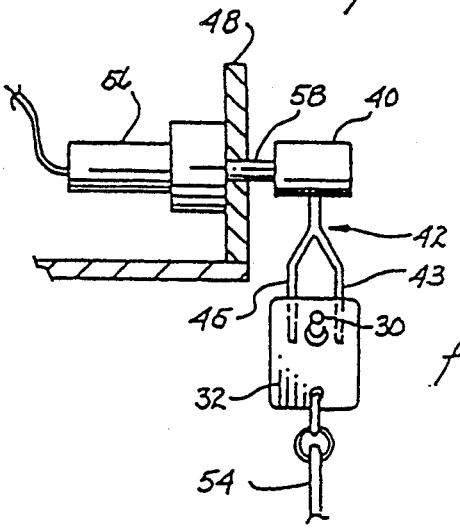
FIG. 3 is a partial side elevational view of FIG. 2 taken along the line 3—3.

FIG. 3 shows the dispensing motor 56, the dispensing motor mounting plate 48, dispensing motor shaft 58 fork hub 40 fork 42, keyring device 32, and key 54. The fork 42 has two prongs 43 and 45 which extend below the key hook 30 as shown such that rotation of the fork 42 by fork hub 40 assures the keyring device 32 is pushed off the key hook 30.

Figure 4:
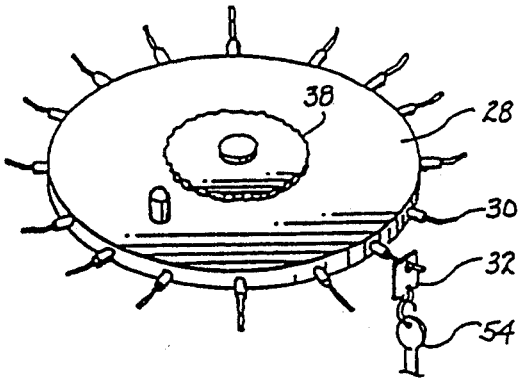
FIG. 4 is a perspective view of the key carousel used in the key carousel assembly of FIG. 2.

The entire carousel plate 38 is shown in FIG. 4. A keyring device 32 with associated key 54 can be placed on each of the key hooks 30 shown. The number of key hooks 30 can vary according to the number of keys to be dispensed.

Figure 5B:
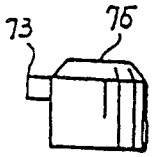
FIG. 5B is a side elevational view of the carousel hub shown in FIG. 5A taken alone the line 5B—5B.
Figure 5A:
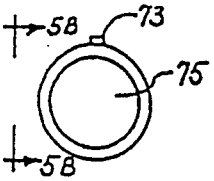
FIG. 5A is a top view of the carousel hub shown in FIG. 5 taken along the line 5A—5A.
Figure 5:
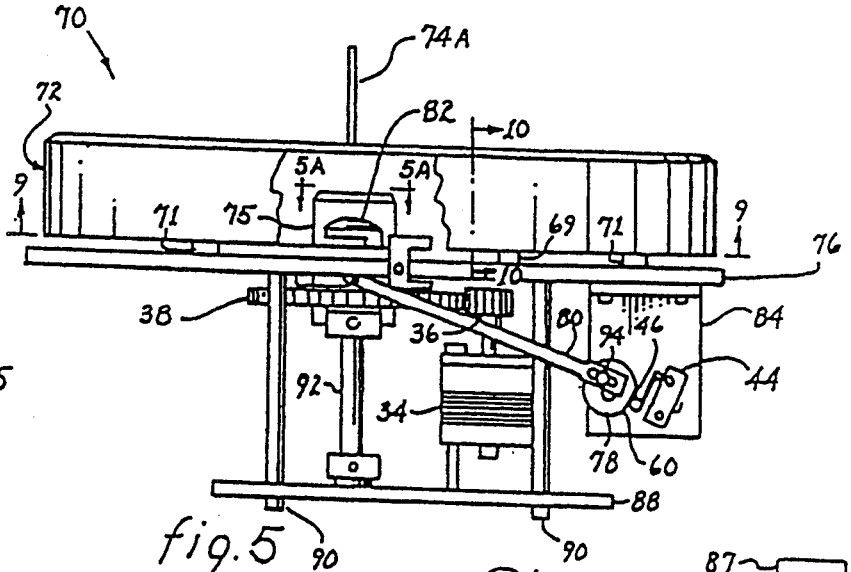
FIG. 5 is a side elevational view of a second embodiment of the present invention showing a key carousel assembly which is used to dispense plastic key cards, with a portion of the carousel cut away to reveal the mechanism that releases the selected key card from the carousel.

Another embodiment of the present invention discloses a key dispenser for plastic key cards commonly known as VING cards, hereafter referred to as key cards. The key dispenser assembly 70 for key cards is shown in FIG. 5. This assembly 70 uses a standard carousel 72 for 35 millimeter slides available commercially from Kodak and other vendors. Carousel 72 has a plurality of slots wherein are placed one item per slot. Note that a plastic key card 74 or some other object can be placed in the slots of the carousel 72. While many different objects could be dispensed in this manner, the following discussion addresses the dispensing of key cards as one specific example, without limiting the scope of the present invention to key cards alone.

The key cards 74 are loaded from the top like slides into the slide carousel 72. Slide carousel 72 is then mounted to the key dispenser assembly, which dispenses the key cards 74 one at time as appropriate.

The top plate 76 has spacers 71 to provide the appropriate spacing between the carousel 72 and the top plate 76. Top plate 76 also has attached thereto an index post 69 for assuring proper alignment of the carousel 72. The top plate 76 is attached to the bottom plate 88 using four mounting posts 90 as shown. The positioning motor 34 is fixedly attached to bottom plate 88. The shaft of positioning motor 34 has a gear 36 fixedly attached, which meshes with and drives a second gear 38. The positioning motor 34 is preferably a stepper motor. The number of steps of the positioning motor 34 and the number and pitch of the gear teeth on gears 34 and 36 determine the positioning resolution of the system, and allow accurately positioning the carousel such that only the one desired key card will be dispensed. Gear 38 is fixedly connected to carousel rotation shaft 92 which is fixedly connected to carousel hub 75, causing carousel hub 75 to turn carousel 72 as the positioning motor 34 turns. Carousel rotation shaft 92 with associated gear 38 are movably mounted to top plate 76 using bearings and carousel hub 75 to allow rotation of carousel 72 in a plane parallel to the top plate 76.

Positioning motor 34 is typically driven by a drive circuit represented in FIG. 7. Inputs ENABLE, PH1, and PH2 are digital logic inputs, and are typically driven under software control to provide the desired stepping sequence, to effect rotation of positioning motor 34 in the appropriate direction for the appropriate number of steps required to align the desired key in the required dispensing position of carousel 72.

Figure 6A:
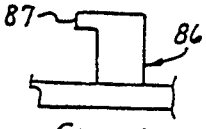
FIG. 6A is a side elevational view of the carousel locking tab shown in FIG. 6 along line 6—6.
Figure 6:
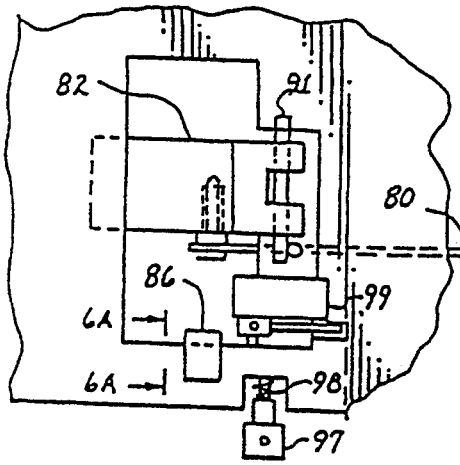
FIG. 6 is a partial top cut-away view of a portion of the key carousel assembly shown in FIG. 5.
Figure 6:
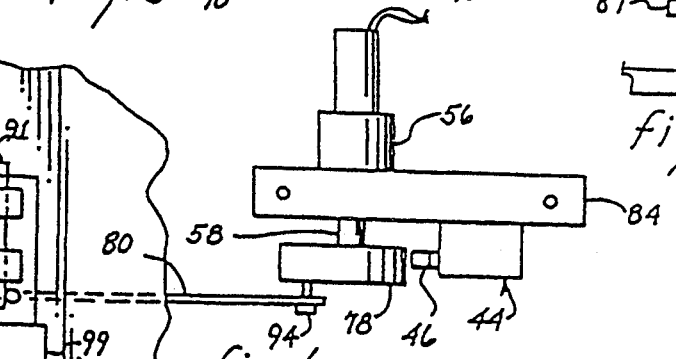

FIG. 6 shows the portion of the key dispenser 70 that performs the dispensing function. Dispensing motor bracket 84 is fixedly connected to the top plate 76 of FIG. 5. Dispensing motor 56 is mounted to dispensing motor bracket 84, and has a shaft 58 therethrough. The shaft 58 of the dispensing motor 56 is fixedly coupled to a gate hub 78. Gate rod 80 is movably attached to the gate hub 78 with rod mounting pin 94. Gate 82 is movably connected to top plate 76 using gate mounting pin 91. Gate rod 80 is used to pull the gate 82 away from the carousel 72, thereby allowing the selected key card 74 to fall out of the carousel 72. Gate hub 78 has a flat side 60 as shown in FIG. 5 to allow limit switch 44 to turn off the dispensing motor 56 after one complete revolution of the gate hub 78.

Figure 8:
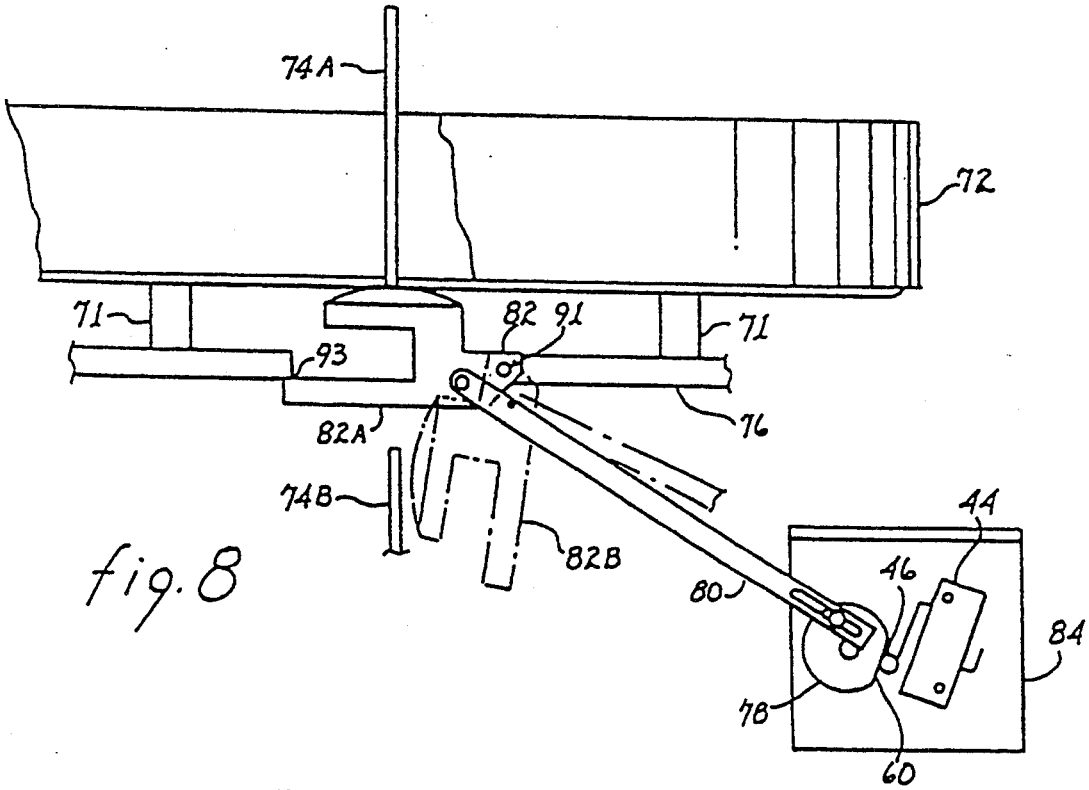
FIG. 8 is a partial side elevational view of the key carousel assembly of FIG. 5 showing the action of the key gate.

FIG. 8 shows how the gate 82 swings aside to allow the key card 74 to fall through the carousel 72. Until the moment when a key card is to be dispensed, the gate 82 is in position 82A, thereby keeping the key card 74 in position 74A as shown. Gate 82 is pivotally connected to top plate 76 using gate mounting pin 91, and is held in position 82A by a spring force (not shown). Gate 82 includes a lip 93 which acts as a stop by contacting a portion of top plate 76 as shown in FIG. 8. Referring to FIG. 6, the dispensing motor 56 is activated under software control until switch actuator 46 is on the round part of gate hub 78, which causes the contacts of limit switch 44 to close, thereby powering the dispensing motor 56. As the dispensing motor rotates the gate hub 40, rod mounting pin 94 retracts gate rod 80, overcoming the spring force holding the gate 82 in position 82A, causing gate 82 to pivot to position 82B shown in FIG. 8. This allows the key card 74 to fall as shown by position 74B. The key card 74 falls into a chute (not shown) which leads to the tray 20 in FIG. 1 wherefrom the person can remove the key card. After the key card 74 has fallen past the gate 82, the dispensing motor 56 continues rotating the gate hub 78 such that the retracting force on gate rod 80 is eventually removed, allowing gate 82 to return to position 82A due to the spring force disposed to hold gate 82 in position 82A. The dispensing motor 56 continues to rotate until the switch actuator 46 again encounters the flat portion 60 of gate hub 78, which causes the contacts of limit switch 44 to open, thereby stopping rotation of the dispensing motor 56.

The activation of the dispensing motor 56 can best be understood by referring to FIG. 7, and is identical to the operation of the dispensing motor 56 described for the case of the first embodiment above. In this manner the dispensing motor 56 is activated for only one revolution each time a key is to be dispensed.

Figure 9:
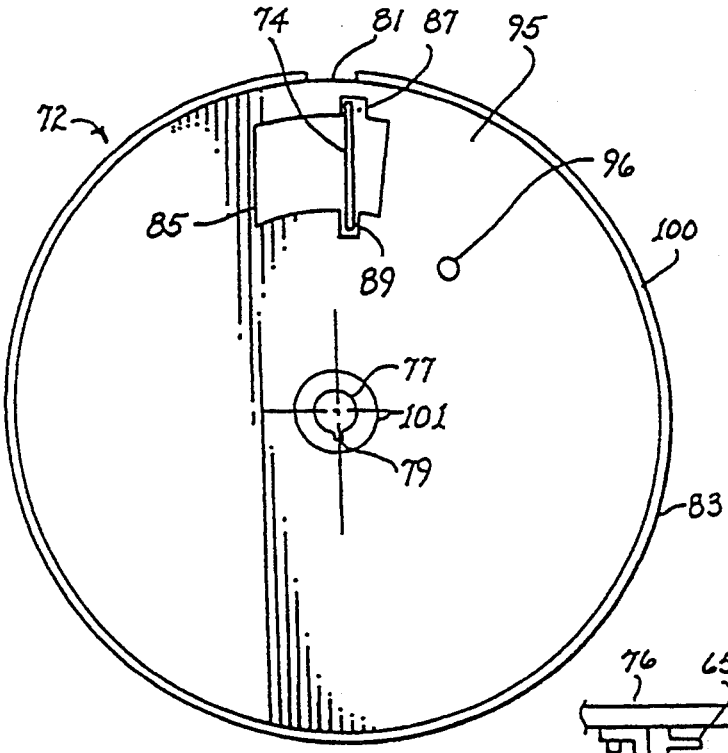
FIG. 9 is a bottom view of the key carousel shown in FIG. 5 taken along line 9—9.
Figure 10:
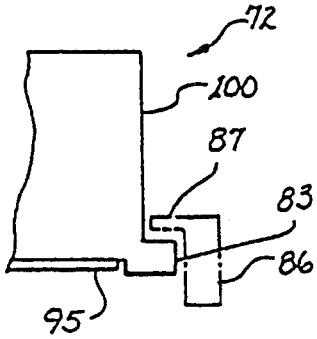
FIG. 10 is a partial cross-sectional view of the carousel shown in FIG. 5 taken along the line 10—10.

As shown in FIG. 9, carousel 72 typically comprises a metal base plate 95 and plastic slide carriage 100. The base plate 95 has various holes and openings. Center hole 101 provides an opening for carousel hub 75 to rotate plastic slide carriage 100. Hole 96 in base plate 95 is an index hole for assuring proper alignment of the carousel 72. Opening 85 in base plate 95 includes recessed areas 87 and 89 which allow the item in the selected slot to pass through the base plate 95. Recessed area 87 also includes an interlocking spring mechanism (not shown) which inhibits rotation of the plastic slide carriage 100 with respect to base plate 95 unless the interlocking spring mechanism is depressed. This interlocking spring mechanism is depressed using knob 97, spring 98, and actuator 99 (FIG. 6) as described hereafter.

FIGS. 6 and 6A show a carousel locking tab 86 which serves as another interlock to ensure proper mounting of the carousel. As shown in FIG. 6A, carousel locking tab 86 is designed to slide past the lip 83 of carousel 72 by way of a slot 81. Once the carousel 72 is in place, rotation of the plastic slide carriage 100 with respect to the stationary base plate 95 places the lip 83 of the plastic slide carriage 100 under the carousel locking tab 86 thereby locking the carousel 72 into place.

The following procedure describes how to attach the carousel 72 to the key dispenser assembly 70. First, it is assumed that the carousel base plate 95 is in the proper position with respect to slot 81. In this position hub 75 with associated keyed portion 73 (FIGS. 5A and 5B) will slide through center hole 101 in base plate 95 into hub opening 77 with associated keyed area 79 of plastic slide carriage 100 (FIG. 9). At the same time, carousel locking tab 86 (FIG. 6) passes through slot 81 in lip 83 of plastic slide carriage 100 (FIG. 9) and carousel index post 69 (FIG. 5) passes through index hole 96 in base plate 95 (FIG. 9). To lock the carousel 72 into operating position, knob 97 is pressed in towards carousel 72, which causes actuator 99 to extend towards the center of carousel (FIG. 6). Once the carousel 72 is correctly seated in place, releasing knob 97 causes spring 98 to retract actuator 99 thereby depressing the interlocking spring mechanism referenced above, allowing the plastic slide carriage to rotate freely. The base plate 95 of carousel 72 remains stationary, while the hub 75 with associated keyed portion 73 is used to rotate the plastic slide carriage 100 with respect to base plate 95 to position the key card to be dispensed over the key gate 82.

The key dispenser assembly 70 includes an interlock feature (not shown) which inhibits rotation of the positioning motor 34 when the carousel 72 is not properly mounted to the assembly.

Figure 11:
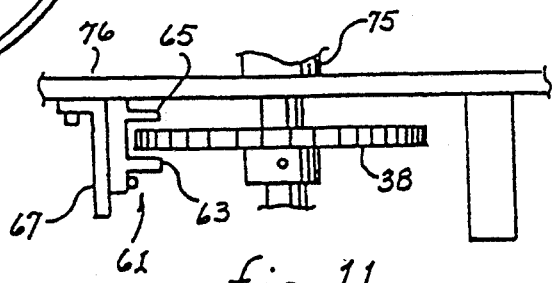
FIG. 11 is a side elevational view showing the optical switch used to detect home position of the key carousel shown in FIG. 5.

FIG. 11 shows the optical switch 61 used to detect home position on the carousel 72. Optical switch 61 is attached to a bracket 67, which is attached to top plate 76. Gear 38 has a hole such that light from transmitter portion 65 of optical switch 61 will contact receiver portion 65 of optical switch 61 when the carousel 72 is in home position, thereby generating the HOME DETECT signal to the control circuitry as shown in FIG. 7.

Key dispenser assemblies 50 and 70 have identical electronic drive circuitry, shown in FIG. 7. This feature allows the same control software to be used in systems that use key dispenser assembly 50 as well as in systems that use key dispenser assembly 70.

OPERATION

Referring to FIG. 1, the key dispenser 10 typically includes a display 12, a paper currency reader 14, a credit card reader 16, a keypad 18, and a tray 20 for removing the dispensed key and a receipt. The receipt printer is not shown, and is internal to the key dispenser 10.

The key dispenser 10 is programmed and keys are loaded into the dispenser from the back of the unit, shown in FIG. 1B. The back of the unit includes a cover 22 for accessing the key carousel, a display 24, and a keypad 26. The manager, proprietor, or employee using the key dispenser 10 programs the needed information into the key dispenser 10 using the display 24 and keypad 26. This information includes which positions of the carousel have keys, and what services these keys correspond to. Before the unit is ready for use keys must be placed in the key dispenser 10 in the appropriate places by removing cover 22.

Once the keys are loaded and the key dispenser 10 has been programmed, the key dispenser may be used by customers. In the specific example of a motel key dispenser, the customer selects from a menu the type of room desired. Some of the possible options would be number of beds, size of beds, number of people, phone in room, cable TV, etc. Once the customer has made an appropriate selection, the display prompts the customer for payment. The customer may choose to enter cash via the paper currency reader or may place a credit card in the credit card reader. Once the key dispenser verifies that payment has been received, it locates home position on the key carousel, and rotates the key carousel in either direction to position the appropriate key to the dispense mechanism in the shortest time possible. The key dispense mechanism is then activated, causing the appropriate key to be dispensed to the tray. A receipt is also printed and dispensed to the tray, wherefrom the customer removes the key and receipt. The key dispenser is now ready for the next transaction.

While the invention has been described in its preferred embodiment, it is to be understood that the words which have been used are words of description rather than limitation, and that changes may be made within the purview of the appended claims without departing from the true scope and spirit of the invention in its broader aspects. As used in this application, the term key includes, for example, standard metal keys as well as other door opening objects such as plastic key cards for use with locks that use electronic means to perform the unlocking function.

I claim:

1. An apparatus for dispensing items comprising, combination:

an external housing;

a plurality of items to be dispensed one at a time located within said housing;

means coupled to said housing for verifying authorization to dispense said items;

a round carousel having a plurality of slots located within said housing and said items to be dispensed are placed one per slot onto said carousel;

locking means for assuring positive engagement of said carousel to said apparatus and for permitting removal of said carousel from said apparatus;

dispensing means comprising:

a gear motor having a shaft;

a hub fixedly attached to said shaft, said hub having a flat side normal to a plane of rotation;

a puller arm movably attached to an eccentric position of said hub to translate rotational movement of said hub to substantially linear movement of said puller arm;

activation means for turning said gear motor;

switch means for stopping said activation means after said hub has accomplished one complete revolution;

gate means nominally disposed in a non-dispensing position and movably coupled to said puller arm for pivoting away from said carousel in a dispensing position and for allowing one of said items to be dispensed to fall by the force of gravity out of said carousel;

access means for loading said items to be dispensed onto said carousel;

means for programming said means for verifying authorization to dispense when said items to be dispensed are placed on said carousel; and rotation means for rotating said carousel until one item to be dispensed is disposed directly above said dispensing means, such that activating said dispensing means causes the desired item to be dispensed to fall by the force of gravity; said rotation means allows for random selection of said items to be dispensed.

2. The apparatus of claim 1 wherein said carousel is of a type used to display 35 millimeter slides on a carousel type slide projector.

3. The apparatus of claim 2 wherein said carousel comprises a base plate, and a plastic slide carriage.

4. The apparatus of claim 3 wherein said locking means comprises a knob coupled to an actuator.

5. The apparatus of claim 4 wherein said locking means further comprises spring force means.

6. The apparatus of claim 4 wherein said locking means further comprises a lip on said plastic slide carriage of said carousel with a slot therein and a locking tab fixedly attached to said apparatus that passes through said slot during installation of said carousel in said apparatus; once carousel is installed and rotated, said locking tab is disposed immediately above said lip thereby restricting movement in the vertical plane, thereby locking said carousel into place until said carousel is rotated to a position to align said slot in said lip with said locking tab.

7. The apparatus of claim 1 wherein said items to be dispensed are metal keys.

8. The apparatus of claim 1 wherein said items to be dispensed are plastic card keys which are used to unlock locks designed for such keys.

9. The apparatus of claim 1 wherein said means for verifying authorization comprises mechanism means for accepting paper currency as payment.

10. The apparatus of claim 1 wherein said means for verifying authorization comprises a keypad.

11. The apparatus of claim 10 wherein said means for verifying authorization further comprises a display.

12. The apparatus of claim 11 wherein said means for verifying authorization further comprises a paper currency reader.

13. The apparatus of claim 11 wherein said means for verifying authorization further comprises a credit card reader.

14. The apparatus of claim 13 wherein said means for verifying authorization further comprises a telephone modem connector device means coupled to a telephone line for the purpose of authorizing use of a credit card read by said credit card reader.

15. The apparatus of claim 1 wherein said rotation means comprises:

a stepper motor having a shaft;

a first gear fixedly coupled to said shaft of said stepper motor;

a carousel rotation shaft;

a carousel hub having a protruding member fixedly coupled to said carousel rotation shaft; and a second gear fixedly coupled to said carousel rotation shaft which meshes with said first gear in a manner to cause rotation of said carousel hub when said stepper motor is activated; the ratio of teeth between said first gear and said second gear is selected to permit accurately positioning said carousel to assure accurate dispensing of only one item.

16. The apparatus of claim 15 wherein said carousel hub with said protruding member positively engages said carousel to effect rotation of said carousel when said carousel hub rotates in response to activation of said stepper motor.

17. The apparatus of claim 15 wherein said rotation means further comprises position switch means for detecting a position of said carousel.

18. The apparatus of claim 17 wherein said position switch means comprises at least one mechanical switch.

19. The apparatus of claim 17 wherein said position switch means comprises at least one optical transmitter and receiver assembly means for generating a signal corresponding to said specific position by passing an optical beam from said transmitter to said receiver.

20. The apparatus of claim 1 wherein said rotation means rotates said carousel in both directions of rotation.

21. The apparatus of claim 1 wherein said rotation means is deactivated when the apparatus is not in use to permit the carousel to be easily rotated by hand for the purpose of placing said items to be dispensed onto said carousel.

22. The apparatus of claim 1 further comprising means for inhibiting said rotation means when said carousel is not properly installed in said apparatus.

23. The apparatus of claim 1 wherein said access means is a covered opening in said external housing accessible only by those authorized to load said items to be dispensed into said apparatus.

24. The apparatus of claim 1 wherein said means for programming comprises a keypad and display.

25. The apparatus of claim 1 wherein said means for programming comprises a connector fixedly connected to said external housing, said connector having external electronic means coupled thereto for loading programming information into said apparatus.

26. The apparatus of claim 25 wherein said external electronic means monitors the activity and status of said apparatus.

27. The apparatus of claim 1 wherein said means for programming comprises a telephone modem connector device.

28. The apparatus of claim 1 wherein said switch means for said dispensing means further comprises an actuator actuated by said hub, said flat side of said hub disposed such that said actuator contacting said flat side of said hub causes switch contacts of said switch means to open thereby stopping said activation means.

29. A method for dispensing items comprising the steps of:

providing a dispensing apparatus having an external housing;

providing a plurality of items to be dispensed one at a time located within said housing;

providing means coupled to said housing for verifying authorization to dispense said items;

providing a round carousel having a plurality of slots located within said housing and said items to be dispensed are placed one per slot;

providing locking means for assuring positive engagement of said carousel to said apparatus and for permitting removal of said carousel from said apparatus;

providing dispensing means comprising:

a gear motor having a shaft;

a hub fixedly attached to said shaft, said hub having a flat side normal to a plane of rotation;

a puller arm movably attached to an eccentric position of said hub to translate rotational movement of said hub to substantially linear movement of said puller arm;

activation means for turning said gear motor;

switch means for stopping said activation means after said hub has accomplished one complete revolution;

gate means nominally disposed in a non-dispensing position and movably coupled to said puller arm for pivoting away from said carousel in a dispensing position and for allowing one of said items to be dispensed to fall by the force of gravity out of said carousel;

providing access means for loading said items to be dispensed onto said carousel;

providing means for programming said means for verifying authorization to dispense when said items to be dispensed are placed on said carousel; and providing rotation means for rotating said carousel until one item to be dispensed is disposed directly above said dispensing means, such that activating said dispensing means causes the desired item to be dispensed to fall by the force of gravity said rotation means allows for random selection of said items to be dispensed.

* * * * *